US005546641A

United States Patent [19]

Radvin et al.

[11] Patent Number: 5,546,641

[45] Date of Patent: Aug. 20, 1996

[54] CLIP FOR RETAINING SHIRT SLEEVES OR CUFFS IN A FOLDED POSITION

[75] Inventors: Bill Radvin, St. Louis, Mo.; Steve Schmitt, Evansville, Ind.

[73] Assignee: Clipps, Inc., Evansville, Ind.

[21] Appl. No.: 408,626

[22] Filed: Mar. 22, 1995

[51] Int. Cl.[6] ..... A44B 21/00

[52] U.S. Cl. ..... 24/557; 24/562

[58] Field of Search ..... 24/555, 545, 562, 24/556, 557, 565, 564, 67.9

[56] References Cited

U.S. PATENT DOCUMENTS

| | | | |
|---|---|---|---|
| 1,477,256 | 12/1923 | Fritz | 24/545 |
| 1,586,656 | 6/1926 | Corey | 24/562 |
| 2,184,569 | 12/1939 | Stewart | 24/556 X |
| 2,547,349 | 4/1951 | Tegarty | 24/137 |
| 3,137,027 | 6/1964 | Birkle | 16/87.2 |
| 3,204,636 | 9/1965 | Konker et al. | 24/562 X |
| 3,247,852 | 4/1966 | Schneider | 24/562 X |
| 3,462,809 | 8/1969 | Froehlich, Jr. | 24/255 |
| 3,797,076 | 3/1974 | Watkin | 24/255 GP |
| 3,962,758 | 6/1976 | Knappe | 24/255 GP |
| 5,113,554 | 5/1992 | Gallo et al. | 24/545 |
| 5,159,730 | 11/1992 | Radvin | 24/543 |
| 5,440,791 | 8/1995 | Guio | 24/562 X |

FOREIGN PATENT DOCUMENTS

| | | | |
|---|---|---|---|
| 666721 | 2/1952 | United Kingdom | 24/562 |

*Primary Examiner*—James R. Brittain

*Attorney, Agent, or Firm*—Haverstock, Garrett & Roberts

[57] ABSTRACT

A clip is disclosed which comprises a unitary body having a pair of opposing arms joined by an arcuate portion and each of the arms having an opposed jaw portion at ends opposite the arcuate portion, each of the jaw portions having an exterior surface and an interior surface, each exterior surface having a finger grip and each interior surface having teeth with each finger grip being positioned above each of the teeth, and at least one of the opposing arms having a planar section adjacent the arcuate portion and an offset section between the planar section and the jaw portion.

18 Claims, 2 Drawing Sheets

CLIP FOR RETAINING SHIRT SLEEVES OR CUFFS IN A FOLDED POSITION

BACKGROUND OF THE INVENTION

The present invention relates to a clip and more particularly to a clip for retaining shirt sleeves or cuffs in a folded position.

Drycleaners are faced with the problem of how to retain sleeves and/or cuffs of shirts in a folded position once the shirts have been cleaned and pressed. Typically, pins, metal clips, or U-shaped clips are used to secure the sleeves or cuffs in a folded position. Although pins or metal clips function to keep the sleeves in place they have a tendency to damage the sleeves due to their pointy or sharp ends. Additionally, the metal clips have pointy teeth at their ends which tend to dig into the shirt material. If care is not exercised in attaching and removing the pins or metal clips considerable damage may occur to the shirt. Additionally, one known U-shaped clip requires other apparatus to be used in conjunction with the clip in order to insert the clip on the garment and retain the garment by the clip. Therefore there is a need to provide a device which secures or retains shirt sleeves or cuffs in a folder position which does not damage the shirt or garment.

SUMMARY OF THE INVENTION

The present device is a clip comprising a unitary body having a pair of opposing arms joined by an arcuate portion and each of the arms having an opposed jaw portion at ends opposite the arcuate portion, each of the jaw portions having an exterior surface and an interior surface, each exterior surface having a finger grip and each interior surface having gripping means with each finger grip being positioned above each of the gripping means, and at least one of the opposing arms having a planar section adjacent the arcuate portion and an offset section between the planar section and the jaw portion.

In another embodiment of the present invention a clip comprises a body including two opposing members having opposite end portions associated respectively therewith and an arcuate portion joining the two opposing members adjacent one of the opposite end portions at their sides, each of the opposing members having opposed jaw portions at the end portions opposite the arcuate portion and each of the jaw portions having an interior surface and an exterior surface, each exterior surface having a finger grip and each interior surface having gripping means, and each of the opposing members having a planar section adjacent the arcuate portion and an offset section between the planar section and the jaw portion.

In still another embodiment of the present invention a clip comprises a body including two opposing members having opposite end portions associated respectively therewith and an arcuate portion joining the two opposing members adjacent one of the opposite end portions at their sides, each of the opposing members having opposed jaw portions at the end portions opposite the arcuate portion and each of the jaw portions having an interior surface and an exterior surface, each exterior surface having a finger grip and each interior surface having gripping means, at least one of the opposing members having a planar section adjacent the arcuate portion and an offset section between the planar section and the jaw portion, and the arcuate portion having a width which is greater than the width of at least one of the opposing members.

It is therefore a principle object of the present invention to provide an improved clip for use in retaining shirt sleeves and/or cuffs in a folded position.

It is another object of the present invention to provide a clip for retaining shirt sleeves and/or cuffs in a folded position without damaging the sleeves or cuffs.

Another object of the present invention is to provide an improved clip which does not have metal teeth or pointy ends which could damage an article of clothing such as shirt sleeves or cuffs.

A further object of the present invention is to provide an improved clip for retaining shirt sleeves or cuffs in a folded position which is easy to manufacture and simple to use.

These and other objects and advantages of the present invention will become apparent after considering the following detailed description in conjunction with the accompanying drawings.

DETAILED DESCRIPTION OF THE PREFERRED EMBODIMENTS

Figure 1:
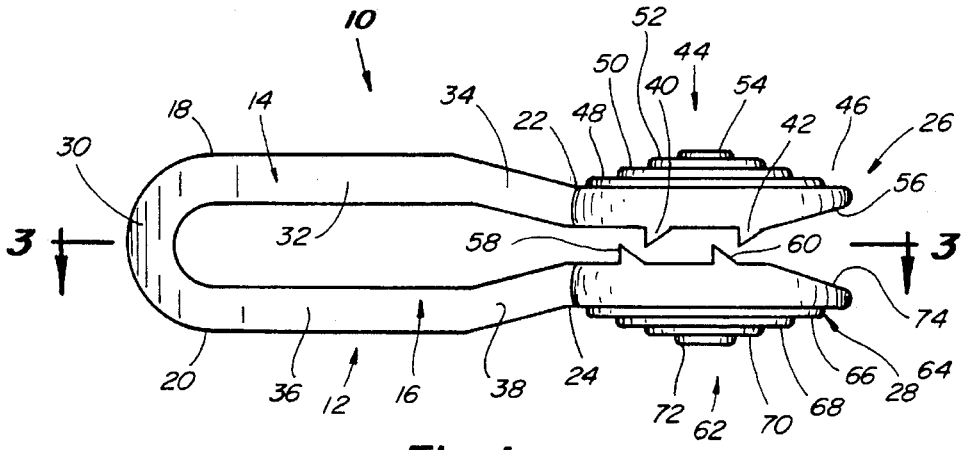
FIG. 1 is an elevational side view of a clip constructed according to the present invention.

Referring now to the drawings more particularly by reference numbers, wherein like numbers refer to like items throughout the various drawings, numeral 10 refers to a clip of the present invention. As shown in FIG. 1, the clip 10 comprises a unitary body 12 which is generally U-shaped. The clip 10 is molded or extruded of plastic. The body 12 has a pair of opposing arms or members 14 and 16 having opposite end portions 18, 20, 22, and 24 associated respectively therewith. Each of the opposing members 14 and 16 has an opposing jaw portion 26 and 28, respectively. Jaw portion 26 is positioned at end portion 22 and jaw portion 28 is positioned at end portion 24. The opposing members 14 and 16 are connected together by a flexible arcuate portion 30 at the end portions 20 and 24. The opposing member 14 and 16 and the arcuate portion 30 form the generally U-shaped body 12.

The opposing member 14 has a generally planar section 32 and an offset section 34. The planar section 32 is connected to the arcuate portion 30 at the end 18. The offset section 34 is connected to the jaw portion 26 at the end portion 22. The offset section 34 is inclined downward toward the jaw portion 28 or is offset from the planar section 32. The opposing member 16 has a generally planar section 36 and an offset section 38. The planar section 36 is connected to the arcuate portion 30 at the end 20. The offset section 38 is connected to the jaw portion 28 at the end portion 24. The offset section 38 is inclined upward toward the jaw portion 26 or is offset from the planar section 36. The offset sections 34 and 38 function to bring the jaw portions 26 and 28 closer together so that the jaw portions 26 and 28 are in a preset or pretensioned gripping position.

The jaw portion 26 has a pair of teeth 40 and 42 which serve as gripping means. The teeth 40 and 42 span the entire width of the jaw portion 26. The jaw portion 26 also has a finger grip 44 on an exterior surface 46 of the jaw portion 26. The finger grip 44 is positioned or located directly above the teeth 40 and 42 of the jaw portion 26. Placement of the finger grip 44 directly above the teeth 40 and 42 allows a user to press the teeth 40 and 42 firmly into a shirt sleeve or cuff. The finger grip 44 comprises a series of concentric circles 48, 50, 52, and 54 of decreasing diameters. For example, circle 50 which is above the circle 48 has a smaller diameter than the circle 48. The jaw portion 26 also has a tip or end portion 56 which is flared outwardly to better accept and receive a shirt sleeve or cuff to be inserted therein.

The jaw portion 28 has a pair of teeth 58 and 60 which serve as gripping means and alternate with the teeth 40 and 42 of the jaw portion 26. The teeth 58 and 60 run the entire width of the jaw portion 28. The jaw portion 28 further includes a finger grip 62 on an exterior surface 64 of the jaw portion 28. The finger grip 62 is positioned or located directly above the teeth 58 and 60 of the jaw portion 28. The finger grip 62 comprises a series of concentric circles 66, 68, 70, and 72 of decreasing diameters. The circle 66 has the largest diameter and the next circle 68 has a smaller diameter than the circle 66. The jaw portion 28 also has a tip or end portion 74 which is flared outwardly to better accept and receive a shirt sleeve or cuff to be inserted therein.

Figure 2:
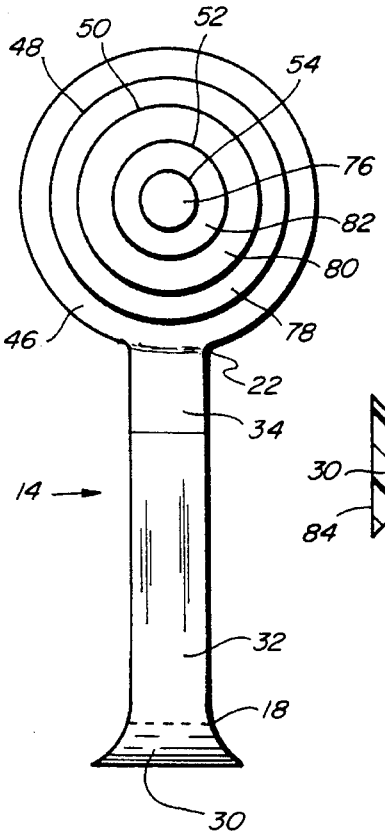
FIG. 2 is a side view of the clip shown in FIG. 1.

FIG. 2 illustrates the top side of the clip 10. The arcuate portion 30 has a width that is greater than the width of the opposing member 14. The arcuate portion 30 is shown to have an increasing width that starts out as the same width as the opposing member 14. The increasing width of the arcuate section 30 functions to strengthen the arcuate section 30. The arcuate section 30 also functions to provide a larger area to grasp the clip 10 when inserting the clip 10 on a garment or removing the clip 10 from a garment. The planar section 32 is connected at the end 18 and continues to the offset section 34. The offset section 34 is connected at the end 22 to the jaw portion 26.

The jaw portion 26 has the series of concentric circles 48–54. The circle 54, which has the smallest diameter of the concentric circles 48–54 and is the topmost circle, has a surface 76 upon which a user may press a finger against when using the clip 10. Additionally, the other concentric circles 48, 50, and 52 have surfaces 78, 80, and 82, respectively, which also allow a user to press a finger against when using the clip 10.

Figure 3:
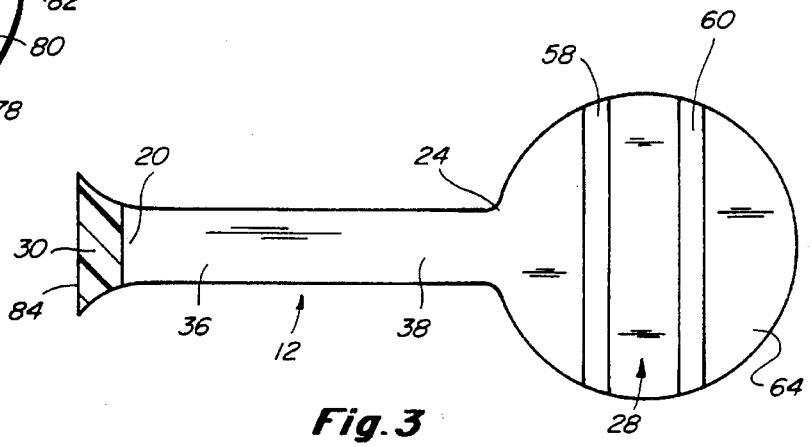
FIG. 3 is a longitudinal sectional view of the clip taken substantially along the plane of line 3—3 of FIG. 1.

With reference now to FIG. 3, the opposing member 16 of the clip 10 illustrates the teeth 58 and 60 spanning the width of the jaw portion 28. The arcuate portion 30 is also shown to have increasing width which starts out being the same width as the width of the opposing member 16 and ends at its maximum width at an end 84 of the clip 10. Again, the arcuate portion 30 is formed having the increasing width to strengthen the clip 10 and to provide a larger surface for which to grasp the clip 10.

Figure 4:
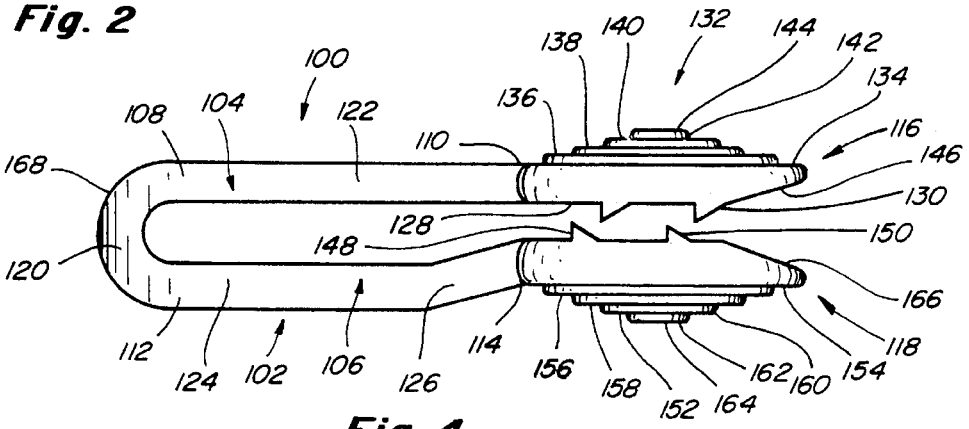
FIG. 4 is an elevational side view of a second embodiment of a clip constructed according to the present invention.

FIG. 4 illustrates a second embodiment of a clip 100 of the present invention. The clip 100 has a unitary body 102 and may be molded or extruded of plastic. The body 102 has a pair of opposing arms or members 104 and 106 having opposite end portions 108, 110, 112, and 114 associated respectively therewith. Each of the opposing members 104 and 106 has an opposing jaw portion 116 and 118, respectively. The jaw portion 116 is connected at the end portion 110 of the opposing member 104 and the jaw portion 118 is connected at the end portion 114 of the opposing member 106. The opposing members 104 and 106 are connected together by a flexible arcuate section 120. The opposing member 104 has a generally planar section 122 between the arcuate section 120 and the jaw portion 116. The clip 100 is similar in several respects to that of the clip 10 with the primary difference between the clip 100 and the clip 10 being that the opposing member 104 has the planar section 122 and does not have an offset section. The opposing member 106 has a generally planar section 124 and an offset section 126. The planar section 124 is connected to the arcuate section 120 at the end 112. The offset section 126 is inclined upwardly toward the jaw portion 116 or is offset from the planar section 124. The offset section 126 functions to bring the jaw portion 118 closer to the jaw portion 116 so that the jaw portions 116 and 118 are in a preset or pretensioned gripping position.

The jaw portion 116 has a pair of teeth 128 and 130 which serve as gripping means. The teeth 128 and 130 span the entire width of the jaw portion 116. The jaw portion 116 further has a finger grip 132 on an exterior surface 134 of the jaw portion 116. The finger grip 132 is positioned or located directly above the teeth 128 and 130. The finger grip 132 comprises a series of concentric circles 136, 138, 140, and 142 of decreasing diameters. For example, the circle 142, which is above the circle 140, has a smaller diameter than the circle 140. The circle 142 has a top surface 144 upon which a user may press a finger against when using the clip 100. The jaw portion 116 also has a tip or end portion 146 which is flared outwardly to facilitate acceptance of a shirt sleeve or cuff which may be inserted therein.

The jaw portion 118 has a pair of teeth 148 and 150 which serve as gripping means. The teeth 148 and 150 span the entire width of the jaw portion 118. The jaw portion 118 further has a finger grip 152 on an exterior surface 154 of the jaw portion 118. The finger grip 152 is positioned or located directly above the teeth 148 and 150. The finger grip 152 comprises a series of concentric circles 156, 158, 160, and 162 of decreasing diameters. For example, the circle 162, which is above the circle 160, has a smaller diameter than the circle 160. The circle 162 has a top surface 164 upon which a user may press a finger against when using the clip 100. The jaw portion 118 also has a tip or end portion 166 which is flared outwardly to facilitate acceptance of a shirt sleeve or cuff which may be inserted therein.

The arcuate section 120 also has an increasing width which starts out being the same width as the width of either of the opposing members 104 or 106 and ends at its maximum width at an end 168 of the clip 100. The arcuate section 120 is formed having the increasing width to strengthen the clip 100.

Figure 5:
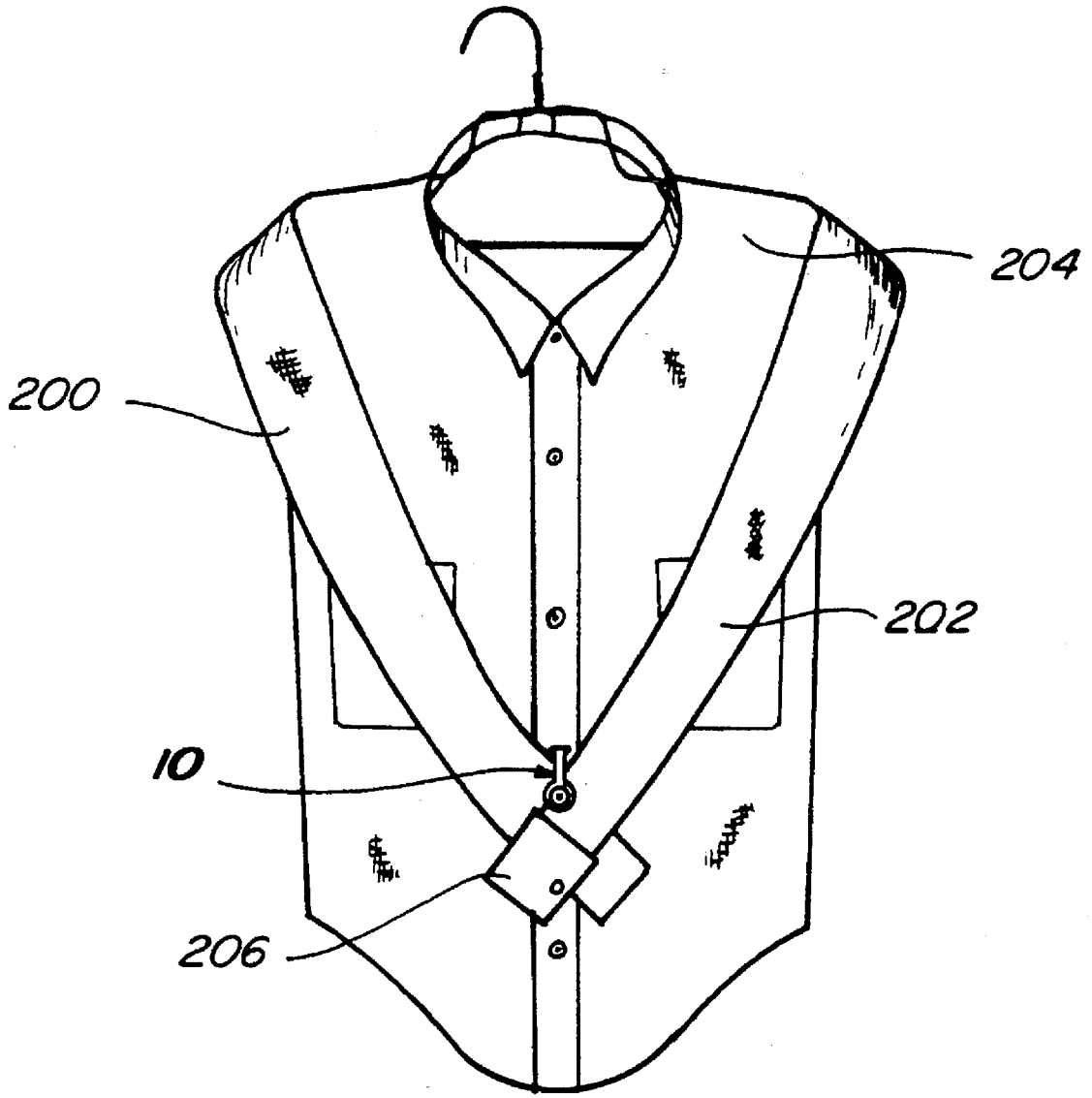
FIG. 5 is a perspective view of the clip of the present invention secured to an article of clothing.

In FIG. 5 a clip 10 is shown positioned in place to retain a pair of shirt sleeves 200 and 202 of a shirt 204 together. The jaw portions 26 and 28 of the clip 10 are closed to grasp and hold the sleeves 200 and 202. In operation after the shirt 204 has been laundered and pressed, the shirt sleeves 200 and 202 are folded in an X configuration and the clip 10 is inserted over the sleeves 200 and 202 to hold the sleeves 200 and 202 together. The flared surfaces 56 and 74 of the clip 10 facilitate separating the jaw portions 26 and 28. Once the clip 10 has been inserted over the sleeves 200 and 202 a user may push the clip 10 further by use of the arcuate portion 30. The clip 10 may be pushed all the way into place by the user pressing the surfaces 54 and 72 of the finger grips 44 and 66, respectively, to insure that the teeth 40, 42, 58, and 60 are pressed into the material of the sleeves 200 and 202 to further retain the clip 10 on the sleeves 200 and 202. To remove the clip 10 the user grasps the arcuate portion 30 of the clip 10 to slide the clip 10 away from the sleeves 200 and 202. The clip 100 functions in much the same manner as the clip 10. Additionally, the clip 10 or the clip 100 may be used to hold a cuff 206 on the sleeve 202 together. Also, if the shirt has a French cuff then either clip 10 or clip 100 may be used to hold the French cuff in place much like a cuff link.

Thus there has been shown and described several embodiments of novel clips which embodiments fulfill all of the objects and advantages sought therefor. It will be apparent to those skilled in the art, however, that many changes, modifications, variations, and other uses and applications tier the subject device are possible. All such changes, modifications, variations, and other uses and applications which do not depart from the spirit and scope of the invention are deemed to be covered by the invention which is limited only by the claims which follow.

What is claimed is:

1. A clip comprising a unitary body having a pair of opposing arms joined by an arcuate portion and each of the arms having an opposed jaw portion at ends opposite the arcuate portion, each of the jaw portions having an exterior surface and an interior surface, each exterior surface having a finger grip and each interior surface having gripping means with each finger grip being positioned above each of the gripping means, and at least one of the opposing arms having a planar section adjacent the arcuate portion and an offset section between the planar section and the jaw portion, each of the jaw portions being circular in shape and having a diameter with the diameters being larger than the width of each of the arms, the arcuate portion having a width which is greater than the width of the arms and less than the diameters of the jaw portions.

2. The clip of claim 1 wherein the offset section is inclined upwardly toward the jaw portion on the other one of the opposing arms.

3. The clip of claim 1 wherein the offset section is inclined downwardly toward the jaw portion on the other one of the opposing arms.

4. The clip of claim 1 wherein the other one of the opposing arms has a planar section between the arcuate portion and the jaw portion.

5. The clip of claim 1 wherein the gripping means comprises a pair of teeth on each of the jaw portions and each one of the teeth spans the entire width of the jaw portion.

6. The clip of claim 1 wherein the finger grips comprises a series of concentric circles on each of the exterior surfaces of each of the jaw portions, the concentric circles having decreasing diameters with the largest diameter being the diameter of the jaw portion.

7. A clip comprising a body including two opposing members having opposite end portions associated respectively therewith and an arcuate portion joining the two opposing members adjacent one of the opposite end portions at their sides, each of the opposing members having opposed jaw portions at the end portions opposite the arcuate portion and each of the jaw portions having an interior surface and an exterior surface, each exterior surface having a finger grip and each interior surface having gripping means, and each of the opposing members having a planar section adjacent the arcuate portion and an offset section between the planar section and the jaw portion, each of the jaw portions being circular in shape and having a diameter with the diameters being larger than the width of each of the arms, the arcuate portion having a width which is greater than the width of the arms and less than the diameters of the jaw portions.

8. The clip of claim 7 wherein one of the offset sections is inclined upwardly toward the jaw portion on the other one of the opposing arms.

9. The clip of claim 8 wherein the other one of the offset sections is inclined downwardly toward the jaw portion on the other one of the opposing arms.

10. The clip of claim 7 wherein one of the offset sections is inclined downwardly toward the jaw portion on the other one of the opposing arms.

11. The clip of claim 10 wherein the other one of the offset sections is inclined upwardly toward the jaw portion on the other one of the opposing arms.

12. The clip of claim 7 wherein the gripping means comprises a pair of teeth on each of the jaw portions and each one of the teeth spans the entire width of the jaw portion.

13. The clip of claim 7 wherein the finger grips comprises a series of concentric circles on each of the exterior surfaces of each of the jaw portions, the concentric circles having decreasing diameters with the largest diameter being the diameter of the jaw portion.

14. A clip comprising a body including two opposing members having opposite end portions associated respectively therewith and an arcuate portion joining the two opposing members adjacent one of the opposite end portions at their sides, each of the opposing members having opposed jaw portions at the end portions opposite the arcuate portion and each of the jaw portions having an interior surface and an exterior surface, each exterior surface having a finger grip and each interior surface having gripping means, at least one of the opposing members having a planar section adjacent the arcuate portion and an offset section between the planar section and the jaw portion, each of the jaw portions being circular in shape and having a diameter with the diameters being larger than the width of each of the arms, and the arcuate portion has a width which is greater than the width of at least one of the opposing arms and less than the diameters of the jaw portions.

15. The clip of claim 14 wherein the width of the arcuate portion increases from a minimum width equal to the width of at least one of the opposing members to a maximum width.

16. The clip of claim 14 wherein the offset section is inclined upwardly toward the jaw portion on the other one of the opposing arms.

17. The clip of claim 14 wherein the offset section is inclined downwardly toward the jaw portion on the other one of the opposing arms.

18. The clip of claim 14 wherein the gripping means comprises a pair of teeth on each of the jaw portions and each one of the teeth spans the entire width of the jaw portion.

* * * * *